US006029289A

United States Patent [19]

Jakobson et al.

[11] Patent Number: 6,029,289

[45] **Date of Patent: *Feb. 29, 2000**

[54] CHAMBER POT FOR CHILDREN

[75] Inventors: Björn Jakobson, Täby; Håkan Bergkvist, Bromma, both of Sweden

[73] Assignee: Baby Bjorn AB, Taby, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,333

[22] PCT Filed: Feb. 20, 1995

[86] PCT No.: PCT/SE95/00173

§ 371 Date: Aug. 15, 1996

§ 102(e) Date: Aug. 15, 1996

[87] PCT Pub. No.: WO95/22275

PCT Pub. Date: Aug. 24, 1995

[30] Foreign Application Priority Data

Feb. 18, 1994 [SE] Sweden ..... 9400562

[51] Int. Cl.[7] ..... A47K 11/04

[52] U.S. Cl. ..... 4/483

[58] Field of Search ..... 4/483

[56] References Cited

U.S. PATENT DOCUMENTS

| | | | |
|---|---|---|---|
| 2,602,166 | 7/1952 | Aitken | 4/483 |
| 4,069,522 | 1/1978 | Messmer et al. | 4/483 |
| 4,193,142 | 3/1980 | Henningfield | 4/483 |

FOREIGN PATENT DOCUMENTS

| | | |
|---|---|---|
| 0 535 625 | 4/1993 | European Pat. Off. . |
| 26 15 883 | 10/1977 | Germany . |
| 25 45 375 | 11/1983 | Germany . |
| 646443 | 11/1950 | United Kingdom . |

*Primary Examiner*—Robert M. Fetsuga
*Attorney, Agent, or Firm*—Jacobson, Price, Holman & Stern, PLLC

[57] ABSTRACT

An injection-moulded plastic child's chamber pot includes a basin part whose wall merges with a seating and supporting part at the top thereof. The front wall part of the basin part slopes obliquely upwards and rearwards in the position of use of the pot. A bottom edge region of an outer wall part, formed integrally with the basin part and the seating and supporting part, and extending downwardly beneath the underside of the basin part, forms a bottom support surface via which the pot is intended to rest on a supporting surface. All pot surfaces define a release angle in relation to the parting direction of two tool halves which form the injection-moulding tool in which the pot is produced and which have a parting plane which coincides with the plane of the support surface and slopes in relation to the normal to the parting direction at an angle corresponding to the angle of inclination of the front wall part plus the release angle of said front wall part.

10 Claims, 3 Drawing Sheets

CHAMBER POT FOR CHILDREN

BACKGROUND OF THE INVENTION

1. Field of the Invention

The present invention relates to an injection-molded child's plastic chamber-pot comprising a basin part whose wall is curved outwardly in an upper region of said basin part and merges with a seating and supporting part on which a child is intended to sit, wherein the basin part and the seating and supporting part are formed integrally with one another, and wherein the front wall part of the basin part slopes obliquely upwards and rearwards when the pot is in use 2. Description of the Related Art Chamber-pots of the aforedescribed kind, see for instance GB Patent No. 646443, reduce in a favorable manner the risk of urine splashes as a child urinates in the pot. However, the inclined front wall part, and therewith the inclination of the whole of the basin, has hitherto caused difficulties, both with respect to manufacture and with respect to use, this latter because the bottom of the basin is moved forwards in relation to the user as a result of the inclined front wall part, therewith increasing the tendency of the pot to tip backwards.

SUMMARY OF THE INVENTION

The object of the present invention is to provide a novel and improved chamber-pot construction in which the aforesaid difficulties are eliminated at least to a substantial degree.

To this end, there is proposed a child's chamber-pot of the aforedescribed kind wherein a bottom edge region of an outer wall part formed integrally with the basin part and the seating and supporting part and extending downwardly therefrom to a location beneath the underside of the basin part forms a bottom support surface via which the pot is intended to rest on a pot supporting surface and which is coincident with at least a substantial portion of a parting edge of the pot, wherein all surfaces of the pot define a release angle relative to the parting direction of two tool halves which form the injection-molding tool with which the pot is produced and which tool halves have a parting plane which, in one embodiment of the present invention coincides with the plane of the support surface and the parting edge and is inclined relative to the normal to the parting direction at an angle which corresponds to the angle of inclination of the front wall part plus the release angle of said front wall part.

In addition to reducing the risk of splashing and also the risk of the pot tipping in use, the arrangement also enables the chamber-pot to be injection moulded in a rational and inexpensive manner.

Further features of the invention and advantages afforded thereby will be apparent from the following description of an exemplifying, non-limiting embodiment of the invention illustrated in the accompanying drawings.

DESCRIPTION OF THE PREFERRED EMBODIMENT

Figure 1:
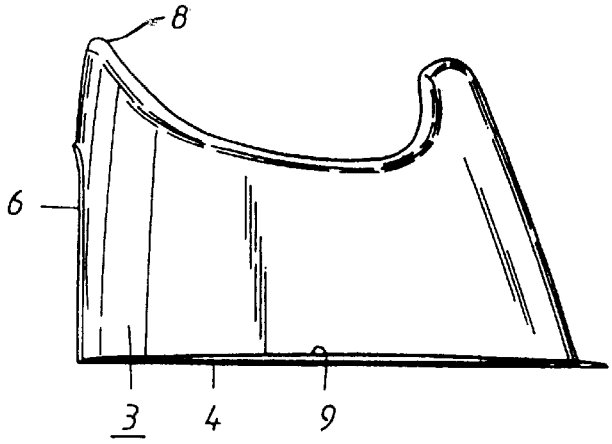
FIG. 1 is a side view of a child's chamber-pot in accordance with the present invention.

Shown in the drawings is a child's chamber-pot which is comprised of an inner basin or bowl part 1 wherein an upper region of the wall is curved outwardly and merges with a seating and supporting part 2 on which the child sits.

Figure 2:
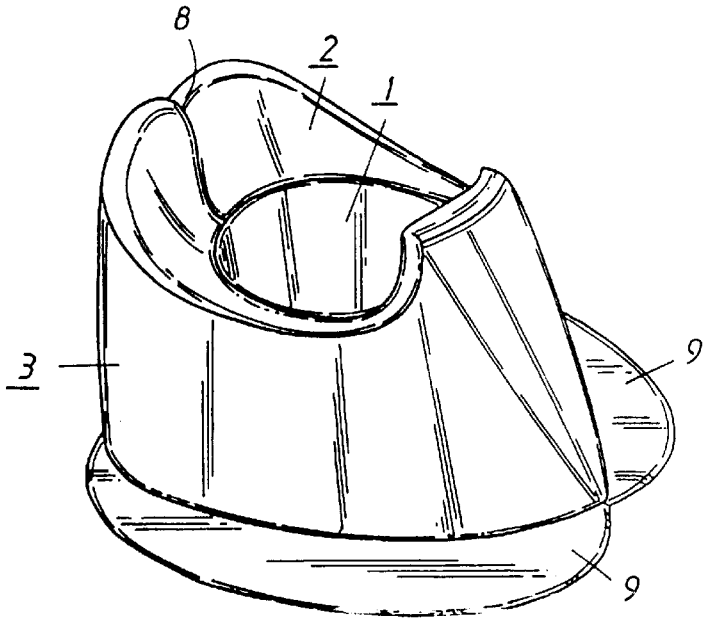
FIG. 2 is a perspective view of the pot shown in FIG. 1, as seen obliquely from above.
Figure 3:
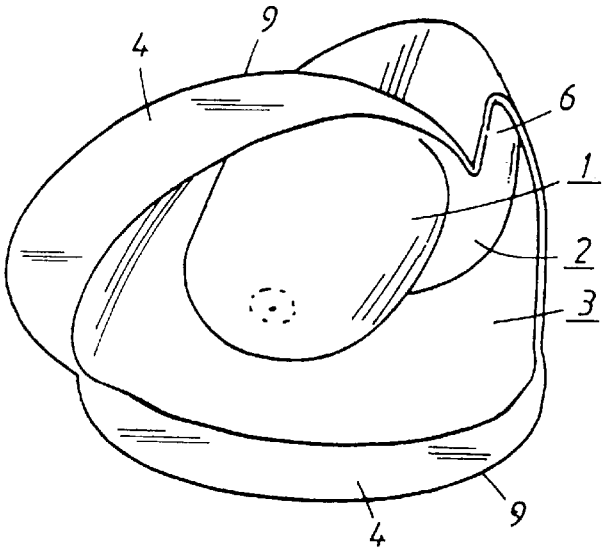
FIG. 3 is a perspective view of the pot shown in FIG. 1, as seen obliquely from beneath.

Extending from the seating and supporting part is an outer wall part 3 which is intended to rest on a supporting surface, such as a floor (not shown), through the medium of a bottom support surface 4 which is comprised of one or more parts. The pot is comprised of a plastic material, for instance an appropriate thermoplastic material. The basin part 1, the seating and supporting part 2 and the outer wall part 3 are formed integrally with one another by means of an injection-molding process effected with the aid of an injection-molding tool shown in FIG. 6. Accordingly, all of the pot surfaces exhibit a release angle in relation to a tool parting direction indicated by a phantom line 5 in FIGS. 4 and 5, so as to enable the tool and the pot to be parted from one another subsequent to manufacture of the pot in the tool. This release angle will preferably be at least about 2°–4°, which is a normal angle in the manufacturing technique concerned. The rear part of the wall part 3 of the pot illustrated in FIGS. 1–3 in one embodiment of the present invention includes a recess 6, as will best be seen from FIG. 3. The pot shown in FIGS. 4 and 5 lacks this recess, but is similar to the pot shown in FIGS. 1–3 in other respects.

The front wall part 7 and parts of the seating and supporting part 2 and the wall part 3 adjoining said wall part 7 have a greater height than the remainder of the basin wall, so as to reduce the risk of splashing when a child urinates in the pot. The pot is also elevated in the rear region 8 of the pot, to provide better support and seating comfort. In the illustrated embodiment, the bottom of the outer wall part 3 includes outwardly angled parts 9, against which the feet of a child sitting on the pot are intended to rest, whereas the undersides of said angled parts 9 form part of the flat support surface 4. The pot is suitably configured so that several pots can be stacked on top of one another, wherein the stacking direction coincides with the parting direction 5.

Figure 4:
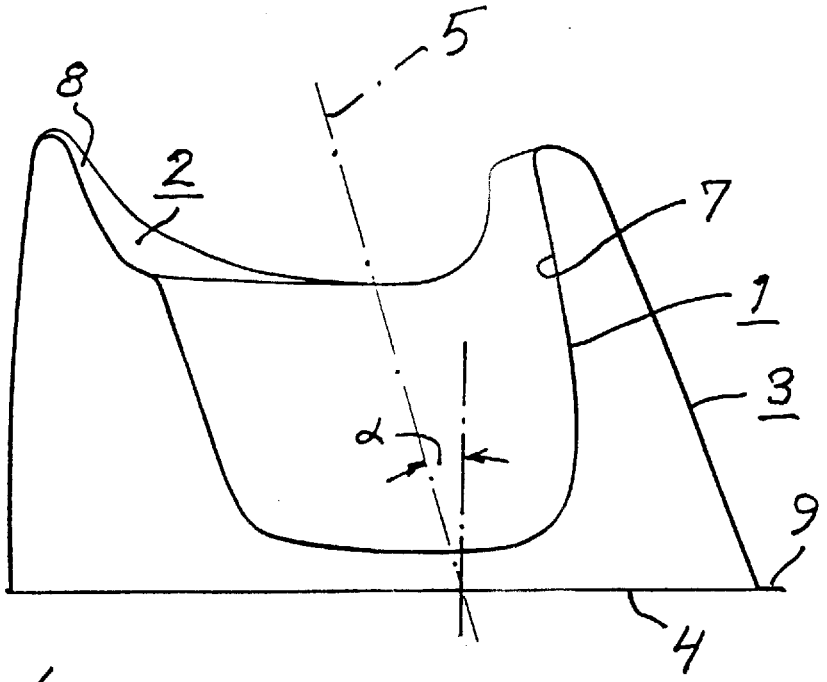
FIG. 4 is a schematic vertical longitudinal section view of a child's chamber-pot which coincides essentially with the pot shown in FIGS. 1–3.

In order to further reduce the risk of splashing, the pot is constructed so that the front wall part 7 of the basin part 1 slopes obliquely upwards and rearwards, as is best seen from FIG. 4. In order to enable the pot to be injection-molded in a rational manner, all pot surfaces define a release angle in relation to the parting direction 5, which is therewith inclined obliquely upwards and rearwards in relation to the plane of the support surface. The angle a at which the parting direction 5 is inclined relative to the normal with the plane of the support surface (see FIG. 4) may preferably lie within an angular range of 15°–20°, wherein the wall part 7 will thus slope at an angle of from 11.5°–16.5° with a release angle of 3.5°.

Figure 5:
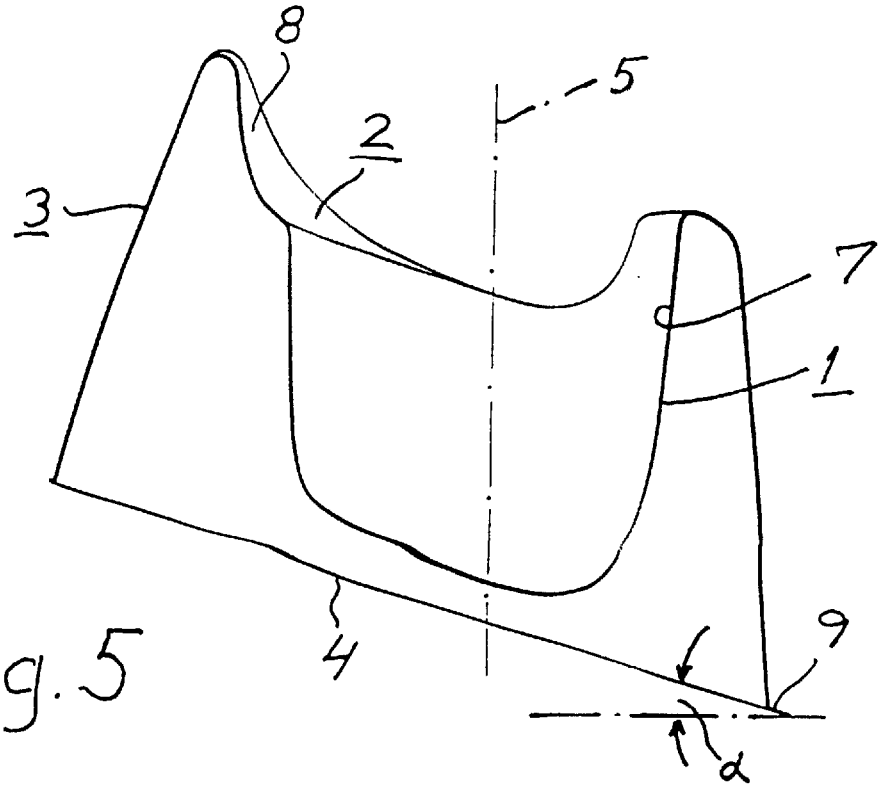
FIG. 5 is a vertical longitudinal section view of the pot shown in FIG. 4 showing the pot as it would be oriented in an injection-molding tool with vertical movement of two molding tool halves and an inclined parting plane between said tool halves.

FIG. 5 illustrates the pot as it would be oriented in an injection-molding tool in which the two tool halves move vertically, namely with the plane of the support surface 4 and the plane of the pot extending parallel with the parting plane (not shown) of the tool halves and being inclined to the horizontal plane at an angle α corresponding to the angle at which the parting direction is inclined to the normal with the plane of the support surface and the parting edge.

Figure 6:
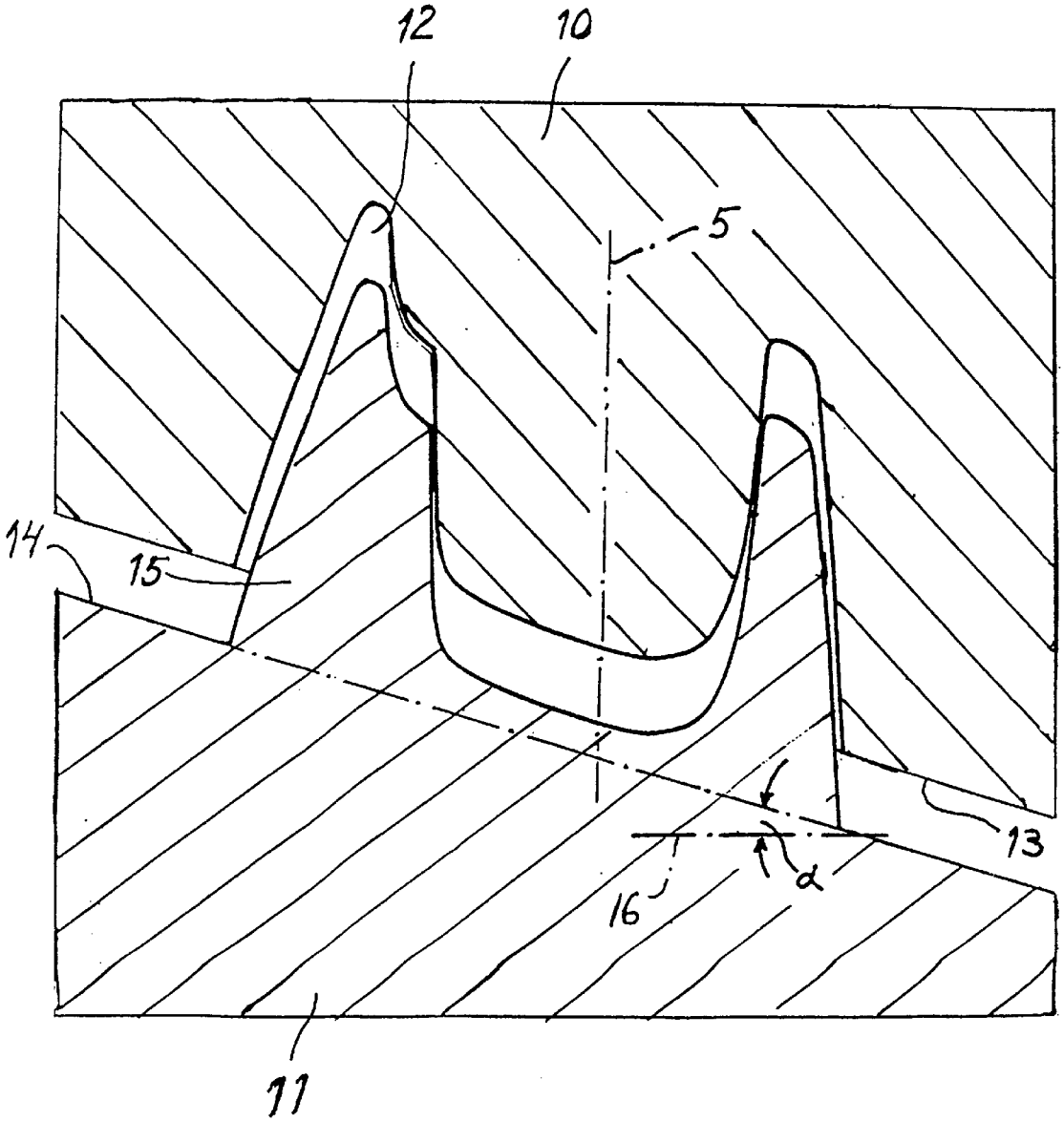
FIG. 6 is a sectional view corresponding to FIG. 1 and illustrates schematically an injection-moulding tool with the tool halves partially separated in accordance with the present invention.

The injection-molding tool illustrated in FIG. 6 includes two tool halves 10, 11 of which the upper tool half shown in the Figure is provided with a mold recess or hollow 12 which extends up from a flat mold-half undersurface or parting plane 13, whereas the bottom tool half includes a patrix 15 which projects up from a flat upper surface or parting plane 14 of the mold half and which, when the planes 13 and 14 are in mutual abutment, defines together with the mould recess 12 a mold cavity which corresponds to the pot illustrated in FIGS. 4 and 5. The parting planes 13, 14 of the partially separated tool halves 10, 11 in FIG. 6 are inclined relative to the normal 16 to the parting direction 5 at an angle α which corresponds to the angle of inclination of the wall part 7 plus the release angle of said wall part.

The invention is not restricted to the illustrated and described embodiment of the invention and can be implemented in any desired manner within the scope of the inventive concept defined in the following Claims.

We claim:

1. An injection-molded child's plastic chamber-pot comprising a basin part having a wall curved outwardly in an upper region of said basin part that merges with a seating and supporting part on which a child is intended to sit, said basin part and said seating and supporting part being formed integrally with one another, a front wall part of said basin part slopes obliquely upwards and rearwards when the pot is in use, a bottom edge region of an outer wall part formed integrally with said basin part and said seating and supporting part and extending downwardly therefrom to a location beneath an underside of said basin part forms a bottom support surface via which said pot is intended to rest on a pot supporting surface, said basin part, said outer wall part and said seating and supporting part forming surfaces of said pot which define a release angle relative to a parting direction of two tool halves which form an injection-molding tool with which said pot is produced, said tool halves having a parting plane which coincides with a plane of said bottom support surface and is inclined relative to a plane perpendicular to the parting direction at an angle which corresponds to an angle of inclination of said front wall part plus the release angle of said front wall part.

2. A pot according to claim 1, wherein said obliquely upwards and rearwards sloping front wall part of said basin part has a greater height than a remainder of said basin part wall.

3. A pot according to claim 1, wherein said parting direction defines an angle in the order of 15°–20° with a vertical line extending perpendicular to the plane of said bottom support surface.

4. A pot according to claim 1, wherein said pot is configured to enable it to be stacked together with similar pots in a stacking direction that coincides with the parting direction.

5. A child's plastic chamber pot comprising a basin having a generally cylindrical basin wall leading upwardly and outwardly to an upper edge having an integral seat and supporting surface for sitting upon when said pot is used, said seat and supporting surface being positioned toward a rear area of said pot, an outer wall depending integrally from said seat and supporting surface and extending downwardly around at least a portion of said basin to form a bottom supporting surface, said bottom supporting surface including a flange outwardly extending from at least lateral sides of said outer wall and having a longitudinally extending curved peripheral edge to support a child's feet and to stabilize said pot during use, said basin wall having a front wall section and a rear wall section that incline upwardly at rearward angles from vertical toward said rear area of said pot, said pot being injection molded in one-piece by two parting tool halves of an injection molding tool with a parting plane coincident with a plane of said bottom supporting surface, said pot having a parting edge defined by the parting tool halves coincident with at least a substantial portion of said plane of said bottom supporting surface, said rearward angle of said front wall section being equal to an angle of inclination of a parting direction of said tool halves from a normal angle of said parting plane less a release angle for said two-part injection molding tool for the surfaces of said basin wall, said seat, and said outer walls, and said rearward angle of said rear wall section being equal to said angle of inclination of the parting direction plus said release angle to ensure removal of said pot from said molding tool.

6. A pot as described in claim 5, wherein said front wall section has a greater height than other portions of said basin wall.

7. A pot as described in claim 5, wherein said angle of inclination of said parting direction is in the order of 15°–20°.

8. A pot as described in claim 7, wherein said rearward angle of said front wall section is in the order of 11.5°–16.5° and said release angle is in the order of 3.5°.

9. A pot as described in claim 5, wherein said pot has a form to allow it to be stacked with similar pots in a stacking direction coinciding with said angle of inclination of said parting direction.

10. A pot as described in claim 5, wherein said outer wall has a recessed portion near said rear area of said pot to facilitate holding and carrying of the pot.

* * * * *